US010224014B2

(12) United States Patent
Nedelman

(10) Patent No.: US 10,224,014 B2
(45) Date of Patent: Mar. 5, 2019

(54) AUDIO EFFECT UTILIZING SERIES OF WAVEFORM REVERSALS

(71) Applicant: Brandon Nedelman, Oceanside, CA (US)

(72) Inventor: Brandon Nedelman, Oceanside, CA (US)

(73) Assignee: Brandon Nedelman, Oceanside, CA (US)

( * ) Notice: Subject to any disclaimer, the term of this patent is extended or adjusted under 35 U.S.C. 154(b) by 0 days.

(21) Appl. No.: 15/396,277

(22) Filed: Dec. 30, 2016

(65) Prior Publication Data

US 2017/0278497 A1 Sep. 28, 2017

Related U.S. Application Data

(63) Continuation-in-part of application No. 15/396,104, filed on Dec. 30, 2016, now abandoned, and a continuation-in-part of application No. 15/395,686, filed on Dec. 30, 2016, now abandoned, and a continuation-in-part of application No. 15/394,806, filed on Dec. 29, 2016, now abandoned, and a continuation-in-part of application No. 15/394,789, filed on Dec. 29, 2016, now abandoned, and a continuation-in-part of application No. 15/393,249, filed on Dec. 29, 2016, now abandoned.

(51) Int. Cl.
*G10H 1/02* (2006.01)
*G10H 1/00* (2006.01)

(52) U.S. Cl.
CPC ..... *G10H 1/0091* (2013.01); *G10H 1/0008* (2013.01); *G10H 2210/051* (2013.01); *G10H 2210/265* (2013.01); *G10H 2220/116* (2013.01)

(58) Field of Classification Search
CPC ..... G10H 1/0091; G10H 1/0008; G10H 2210/051; G10H 2210/265; G10H 2220/116
USPC ..... 84/630
See application file for complete search history.

(56) References Cited

U.S. PATENT DOCUMENTS 4,015,089 A * 3/1977 Ishii ..... H04R 3/14 381/89
4,984,276 A * 1/1991 Smith ..... G10H 5/007 381/63
5,090,291 A * 2/1992 Schwartz ..... G10H 1/0575 84/603
5,245,663 A * 9/1993 Green ..... G10K 11/175 381/61
5,350,882 A * 9/1994 Koguchi ..... G10H 1/02 84/612
5,467,288 A * 11/1995 Fasciano ..... G06T 17/00 715/202
5,509,079 A * 4/1996 Green ..... G10K 11/175 381/61
5,512,704 A * 4/1996 Adachi ..... G10H 7/04 84/605
5,982,907 A * 11/1999 Akamatsu ..... H03G 5/10 333/28 T (Continued)

*Primary Examiner* — Elvin G Enad
*Assistant Examiner* — Christina Schreiber

(57) ABSTRACT

The invention is a process for the creation of an audio effect in the context of an audio editing software. The effect is created by applying a series or sequence of reversal instances across a sample or waveform in time.

1 Claim, 5 Drawing Sheets

(56) References Cited

U.S. PATENT DOCUMENTS

| | | | | | |
|---|---|---|---|---|---|
| 5,990,409 | A * | 11/1999 | Takahashi | G10H 1/0008 | 250/200 |
| 6,047,073 | A * | 4/2000 | Norris | G10H 1/0066 | 381/61 |
| 6,355,870 | B1 * | 3/2002 | Tsai | G10H 7/02 | 84/605 |
| 6,479,740 | B1 * | 11/2002 | Schwartz | G10H 1/0091 | 84/605 |
| 8,689,139 | B2 * | 4/2014 | Baird | G06F 3/0482 | 715/810 |
| 9,171,532 | B2 * | 10/2015 | Maezawa | G10H 1/40 | |
| 2008/0013757 | A1 * | 1/2008 | Carrier | G10H 1/0008 | 381/119 |
| 2015/0110281 | A1 * | 4/2015 | Mizuhiki | G10H 1/0091 | 381/61 |
| 2016/0071524 | A1 * | 3/2016 | Tammi | H04N 5/77 | 386/343 |
| 2017/0155413 | A1 * | 6/2017 | Kroeger | H04B 1/123 | |
| 2017/0278497 | A1 * | 9/2017 | Nedelman | G10H 1/0091 | |
| 2017/0363715 | A1 * | 12/2017 | Li | G01S 13/581 | |

* cited by examiner

AUDIO EFFECT UTILIZING SERIES OF WAVEFORM REVERSALS

TECHNICAL PROBLEM

Stuttering vocal effects, as made popular in the music of Kanye West, can be accomplished in a DAW audio production or editing workstation using plugins and effects utilizing the pitch modulation of a vocal sample. The Kanye West style stutter effect is created by using an autotuned or pitch correction effect or plugin. https://www.youtube.com/watch?v=cBhersTxUtM at 3:37 is a demonstration of a producer using this said vocal effect. Also, the group Eiffel 65's track titled "Too Much of Heaven" features use of this effect during the songs first verse, which is viewable at: https://www.youtube.com/watch?v=DZ8PfXOV1fU. South park has even created a parody music video of Kanye west that dramatically and proportionally emphasizes this tragic vocal technique. http://southpark.cc.com/clips/224099/im-going-home. While these stutter or vocal stagger effects are cool, they are becoming overused by many hip hop artists and producers who are "killing it", or in other words, it is being used so frequently to the point where the novelty of the audio effect is wearing off, rendering it as "generic" and "commonly used by everybody". The world needs a new type of stutter effect that is similar, but has a new mechanism of action or flavor because the sound of the "Kanye West Stutter" has become so boring due to extensive use by a lot of recording artists.

SOLUTION TO PROBLEM

The invention yields an audio effect software application that creates a new style of vocal fragment or stuttering. It is like the "Kanye West Style Vocals", however it sounds new, unique, original, and different. This solves the issue of the generics that has now become associated with the Kanye stutter technique of vocal processing. Like any audio effect or instrument, a blanket solution or use of this invention is self-expression in audio for both professional and hobbyist musicians. No current or previously released software performs the function and process described in this invention.

BACKGROUND ART

DAW or audio editing workstations are full computer and interface hardware and software configurations for producing, recording, and editing audio. Protools, Logic, Ableton Live, Fruity Loops Studio, Cakewalk, Garage Band, Sonic Foundry, are to mention a few, some popular brands and products. Most DAW programs feature an ability to add plugins or effects. The effects can be added to one file or track in the multitrack set up, or they can be applied over the entire rendered song via the "master track" application of the effect or plugin. Post-recorded effects differ from real time effects, such as software instruments, or most digital audio effects, in the sense that they are applied to an already recorded sample after it has already been recorded. This invention is not applied to the sample as it is being played, sung or recorded, but rather, the effect is applied to a processed and analyzed sample after it has been recorded into the program. Digital audio reversal is the reversal of a sample or waveform using a computing hardware and software system. A few, but not many, patent literatures have been published since the 1980s in regards to audio effects involving the reversal of a sound.

DETAILED DESCRIPTION OF THE INVENTION

The invention applies a series of reversal instances placed over a vocal sample, instrument sample, track, audio portion or otherwise sample or waveform. An entire track may be selected or a portion thereof, to apply the effect to. Multiple tracks may be selected for the application of this effect as well.

The parameter command functions of the software are initiated via a plug-in effect "sub menu", of the display portion of the software interface.

Articulations: Individual waveform "articulations" are indicated in waveforms by waveform attributes as derived from specific wave shape characteristics. Waveform attributes such as hits, peaks, valleys, spikes, attack, sustain, release, etc., are some examples of analyzable waveform attributes. An articulation is a separately distinguishable music portion or part in a series, composition, or arrangement of a plurality of said portions or parts. Articulations generally are correlative to separately performed individual notes, beats, words, hits, etc. For example, in a melody performed and recorded on guitar, generally each separately played note is one separately distinguishable articulation, per said note. Some exceptions may apply to this. For example, the slurring or legato of notes may be considered separate instances of articulation than one per note hit. For example, one articulation is usually one note, word, chord, hit, etc. The user may select to place multiple timed instance presets in the relative center range. The user may select to automate the instance durations and placements based on speech analysis. Speech analysis options can be geared towards different effect output styles based on how the instance is placed in the center of an articulation, in terms of starting point, duration, and if multiple instances are placed. Articulations contain what I refer to as a middle or relative center. This is a defined as an approximate range of distance inside the articulation, which makes up what is the center of the articulation. Waveform terminology refers to the portions of an articulations as 1. Attack, 2. Peak, 3. Decay, 4. Sustain, and 5. Release. In a classic view of a single instrument track, this is likely the general case. So, the range comprising the relative center of an articulation is located between the earliest attack point and latest release point. Classically, most of the relative center range portion would fall into the "sustain" portion of the waveform articulation. However, different articulations have different waveform attributes, so the exact range of relative center is approximate and may vary from articulation to articulation. It is safe to say that the relative center begins after the articulation peak and ends around the middle or middle end of the articulation's release.

Interface: Sub menu workstation interface: The software features a sub menu box or sub interface. The sub menu box or interface offers user-selectable parameter commands of which the series of reversals will be applied to over the selected portion of audio. The user may select to have the system automatically apply the series or sequence of reversals based on waveform attributes by utilizing the automation/automatic function of the sub menu. Waveform attribute analysis incorporates the analysis of both "peaks and valleys" of what an image of a waveform looks like at various zoom levels. The selection of effect parameter command functions is initiated via the interface or sub menu of the larger DAW workstation program as depicted the sub menu is selected as an option from a larger menu of all the DAW workstations plugins and effects, depicted. The sub menu features 2 primary functions. The first set of selectable parameters is automatic mode. The second is advanced mode. Upon selection of automatic mode, the functions are for the most part automated with minor tweakable command settings doable through the user interface. Upon selection of advanced mode, the parameter options are customizable with advanced settings dictating the parameters of applied reversal instances.

Sub menu: automatic mode: The automated application function of the software works by applying its algorithm to first analyze the selected audio sample or portion of which the effect will be applied to. The waveform is analyzed for measurements which are indicative of articulations inherent in the sample or waveform. These are referred to as waveform attributes. The automatic command function/application of instances can be enhanced by selecting a command of the sub menu indicating for the algorithm to use speech analysis. The vocal track is scanned using speech analysis. Phonetic factors such as the duration of held vowels, and consonant transitions between phonetic portions, are factored into the reverse instance application parameter functions. The middle of an articulation consists of the "range" making up the middle portion of a hit. This is a range referred to as the relative center of an articulation. The amount of time that the reversal instances are applied to the articulation relative centers, or ranges, as well as starting points of the reversal instances, are dependent on the speech analysis portion of the software. Different parameter values of applied instances to the relative centers of articulations can alter the audible effects generated. One can select the software to generate the effect for a less audible "sustain style effect", or select a more drastic "stutter style' preset. Both preset example outcomes are dictative of the parameters of the automatic placement of reversal instances pursuant to the placement as determined by the speech analysis portion/function of the software. Selecting a higher or lower intensity level in automatic application mode applies different parameters to the automation in terms of onset, duration, and volume/amount of applied reversal instances. The user may select to automate instances based on articulation analysis. This is automatically applied by utilizing the sub menu automation function. The following paragraph options can be further applied to this paragraph. The user may select from waveform attribute parameter or command options based on articulations. The user may select to place the instances in the relative center of articulations by initiating automation. This is also done automatically by selecting the sub menu automation mode. The relative center is the waveform range of the articulation located in the center of the articulation. The relative center or center range of an articulation is a range value of the said middle portion making up the relative center range of the articulation. The automated reverse series application can vary as to which portion(s) of the range(s) that the instances are applied to, based on the above stated software analysis of the waveform articulations or hits.

Sub menu: Advanced mode: Advanced mode features (not pictured) completely customizable application settings for applied reversal instances. Advanced parameters are engageable in this mode including but not limited to advanced timing parameters, advanced onset parameters, and advanced duration parameters. The sample selected is also analyzed for its tempo or "BPM" in advanced mode, and its corresponding note duration value of its "hits" or rhythmic values of audible elements or articulations are processed. The series or sequence of reversals may be parameterized in the advanced sub menu option by parameterization of reversal instance duration, spacing between the instances, synchronous in timing specified duration parameters, etc. For example, one could select a command corresponding that, 1 reversal occurs timed on every off beat, lasting for half a second per reverse instance. One could select 3 second reversal duration instances. The user may further select a program function responsive to the number of reversal instances that may be placed per articulation (center).

Generally, the most appealing effect utilizes the amount of one single instance placed per articulation (center).

Processing: Waveform analysis takes the attack, sustain, release, onset, etc., of articulations (which are calculated using a tempo or bpm relating sensing process) and can determine what the relative center of each articulation instance is. Likewise, in automation mode, the instances of audio reversal are automatically placed in different parameters for each different articulation relative center. Since waveform attributes vary from articulation to articulation, the applied reverse instances vary in each articulation/instance. Similarly, the overall scope of the effect created by the applied reversal series (intensity) is adjustable in automation mode to yield different effects. The process can, for a given intensity level selection, automatically place the reversal instances in such a way that the parameters (onset, duration) are applied to yield such a selected level of intensity. The spectrum of intensity ranges from an "audio sustain" style of effect which generally utilizes smaller durations of reversal instances placed "more toward the middle of the articulation relative center". Similarly, the other spectrum of intensity favors "glitchy, choppy, or stutter" sounding outcomes. Likewise, a glitchy or stutter reversal instance usually is achieved, generally, by applying the reversal instance in a longer duration over the more/majority of the entire relative center of the given articulation. Speech analysis also can be calculated into the automation. Transitions between phonetic attributes and elements in speech samples can dramatically alter what the reversal instance parameters will require per the desired effect. For example, a vibrato or sustained vowel will require different parameters of applied reversal. Also, consonant/consonant and consonant/vowel transitioning. By selecting to apply speech analysis to the overall calculation process, the software can more accurately apply and parameterize reversal instances placed in the relative center of each articulation, to produce more desirable results per automation. Similarly, analyzed waveform attributes of both speech and non-speech articulations also are calculated into the algorithm for determining the parametrization of placed reversal instances. Waveform characteristics per each articulation of an audio track may yield requirements for automation parametrization such as onset, duration, or offset bias of placement of the reversal in the relative center. An offset or biased placement of a reversal is the placement of a reversal instance (in the articulation relative center) more toward one side of the relative center.

SUMMARY

Summarized, the process is one which analyzes a selected sample of audio waveform to generate an automated placement of calculated reversals over portions of the sample. The result is a perceivable audio effect like distortion, reverb, delay, etc. The result is achieved by first finding the samples articulation measurements. Then, the reversals are applied to calculated portions of the sample articulations (within the middle/center of each articulation) to produce a desired effect. The onset and duration parameters of applied reversal (otherwise defined as the "portion" of audio being reversed) is calculated based on a desired level of this creatable effect. The correct portion parameters of which to apply reversals can be calculated using measured waveform/articulation properties, by calculating the reversal parameters as they will respond the output result based on waveform characteristics accordingly. For example, if I want a glitchy or choppy result of this effect, the reversal parameters can be calculated by a. selecting this level of desired effect, b. determining what reverse parameters are applicable to create this effect based on waveform properties, and c. applying such reversal parameters to achieve the desired effect. In some instances, reversing the entire center of the articulation will produce the desired effect. In other scenarios, the desired effect may entail reversing a small portion of "the inner-most center", slightly offset or shifted to the left. Similarly, waveform properties will render the need to calculate the reversal placement for each articulation individually to more accurately create an application of this effect. A skilled audio engineer will be familiar with waveform property and pattern definitions correlative to the application of reversal functions of this invention. A skilled software will be able to utilize audio spectrum finite rules relating to applied reversal scenarios to specific wave shape generalized scenarios. Further a database of memory programmed functions or processing rules can integrate calculated, observed rules associated with definite property/elements pertaining to waveforms/shape/type generalized definitions or types, as their inherent waveform properties are predictably reactant in specified manners pursuant to a specified, application of the reversal function of this invention. The inherent finite properties of the audio processing functions further are integrated into a user friendly graphic software interface for the control and dictation of the invention/functions.

Process Summary

1. A waveform, sample, or portion thereof is selected;
2. The waveform properties are measured;
3. Articulation data is defined, measured;
4. A selection of a level or "intensity" indicative of one or more audio spectrum measurable properties are, selected.
5. The waveform properties are measured against the selected spectrum parameters to calculate the best possible placement parameters (portions) of the applied reversal instances;
6. As calculated, a portion of each articulation (in the middle or center) is reversed accordingly to said calculations;
7. The audio effect is rendered.
8. The audio can now be played back once it has been rendered, yielding the desired results/effects.
9. Waveform property measurement may extend to include as mentioned previously, phonetic measurements,

Advantages of Invention

This invention is applicable and beneficial to everyone on the market, including record producers and hobbyists, because its results are innovative and new as a sound effect that is unlike any other previously available or apply able sound editing process/function/effects. It is market applicable to DAW software as an integrated feature process or plugin that creates a novel spectrum of producible audio outputs that is useful to many people in terms of music or the audio industry.

BRIEF DESCRIPTION OF DRAWINGS

Description of Embodiments

Figure 1:
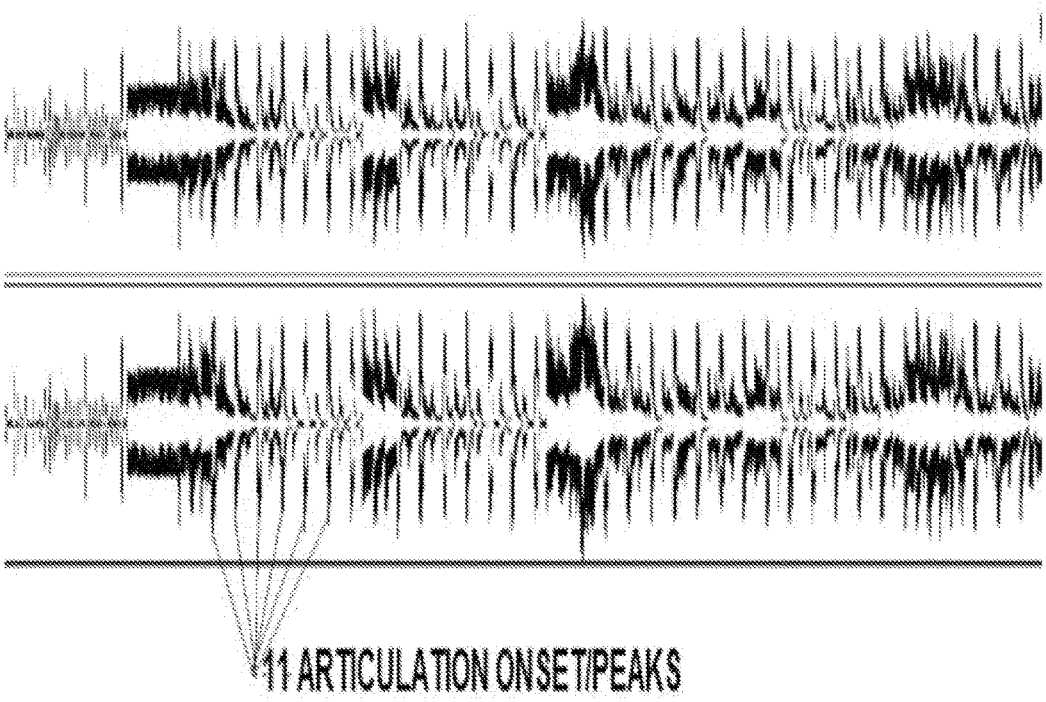

FIG. 1 is a view of a waveform with amplitude peaks/percussive hit articulation sounds. 11 are the most prominent articulations (percussive hits/articulations onset/peaks) viewable at this zoom level of the waveform image.

Figure 2:
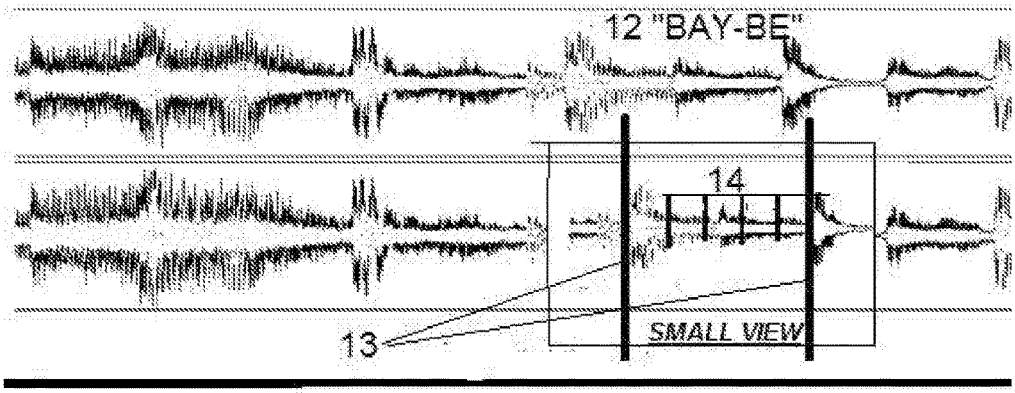
Figure 2:
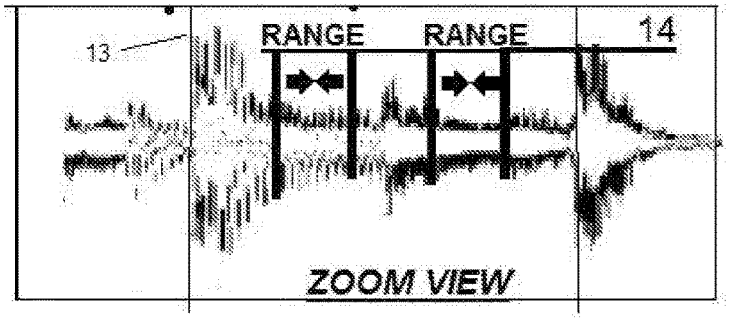

FIG. 2 is the waveform attributes at a closer zoom level. 12 is the lyrics of the audio sample that was used. 13 are articulation peak/onsets. The beginning of the new articulation onset in the example marks the end of the previous entire articulations. 14 are the relative center or ranges of the articulations. They are indicative of ranges that are the relative middle of the entire articulation.

Figure 3:
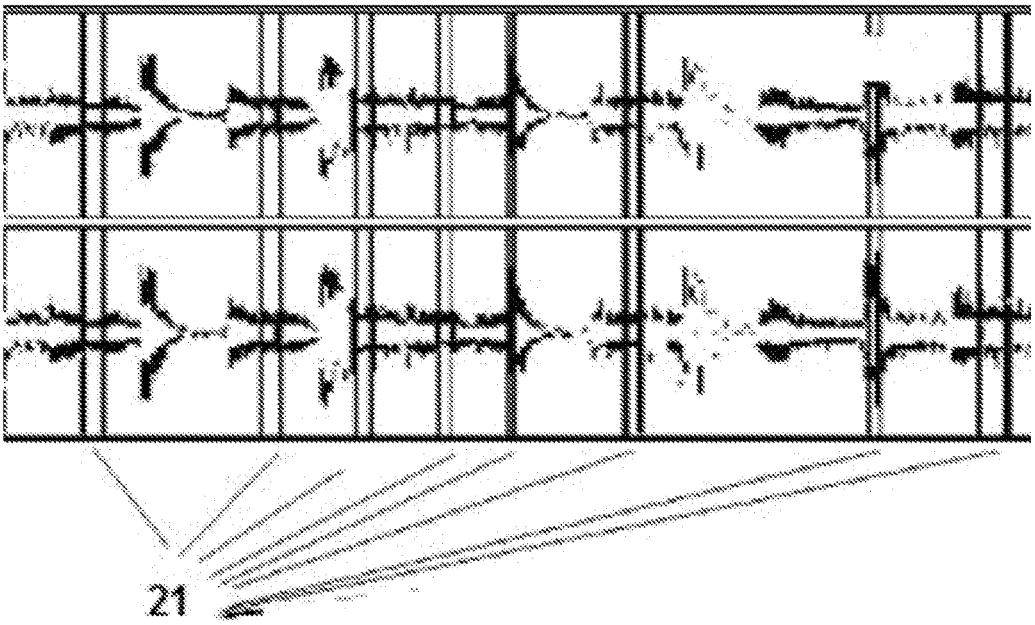

FIG. 3: 21 is the application of the series of reverse instances to the relative centers of lyric articulations.

Figure 4:
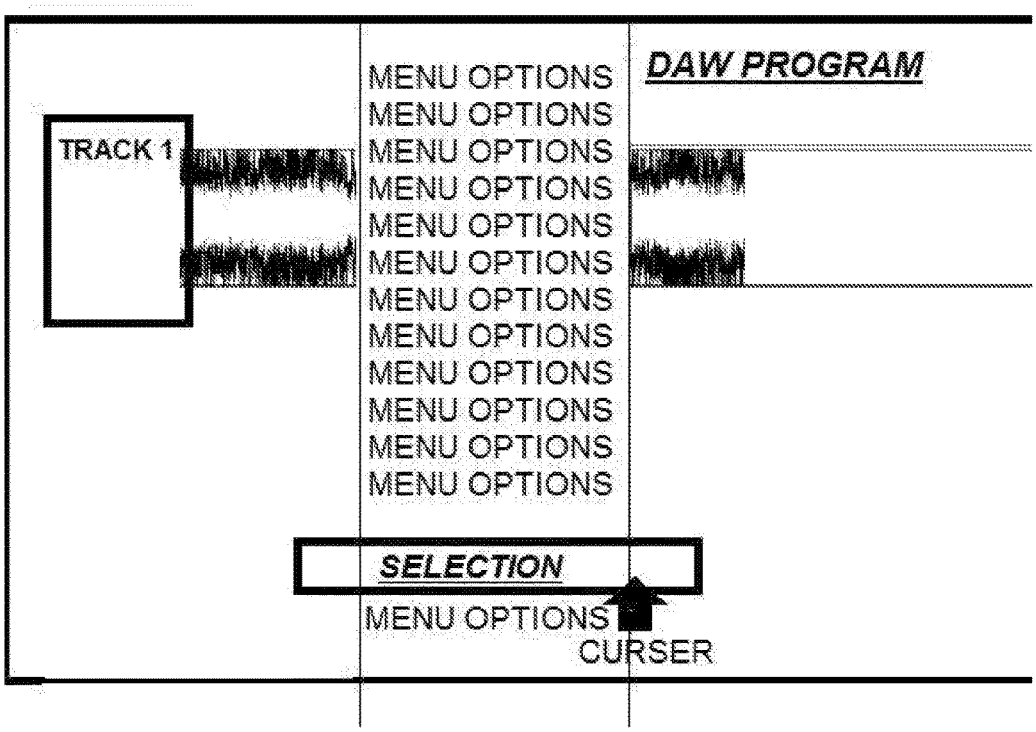

FIG. 4 is the selection/initiation of the sub menu interface plugin in the daw program.

Figure 5:
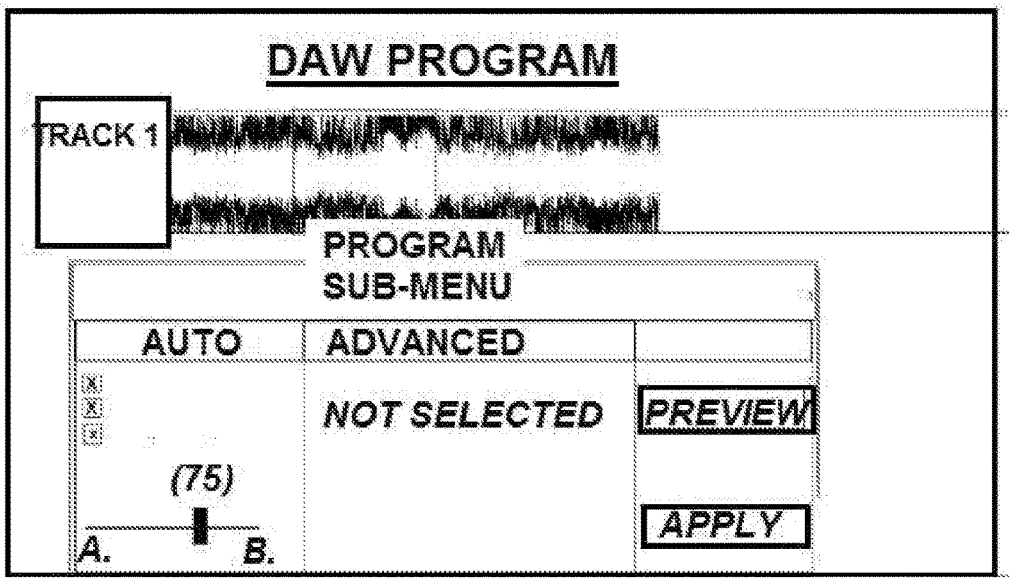

FIG. 5 depicts the daw programs inherent sub menu function in the program. Automatic mode is depicted on the left side of the sub interface, while advanced mode (not illustrated) is partially pictured in the middle of the sub interface in the middle of the sub interface. The right side of the sub interface are preview and render functions.

Definitions

Reversal instance: a reversal applied to a portion of an waveform. For example if only one area of the articulation is reversed, it is one reversal instance. If two areas of a waveform are reversed, this is two separate reversal instances.

Location: refers to the point in time or location of a reversal instance, or point in time or location of the specific time-areas that the onset/start and offset/end of a reversal instance are placed. For example, if 1:30:00-1:35:36 is the portion of the waveform reversed (as one reversal instance), then 1:30:00 and 1:35:36 are the respective onset/start and offset/ends of the reversal instance. Location of the onset and offset may be referred to as "point".

An area of a waveform is generally displayed in time, lengthwise, across the horizontal length of the display of a computer running a DAW program. The rightmost area is 0:00:00, wherein the leftmost area is the end of the waveform.

The invention claimed is:

1. A method for utilizing a series of reversal instances comprising:

analyzing an audio sample for articulations:

reversing portions of the audio sample consisting only of centers, or relative centers, of said articulations; and applying speech analysis to determine the duration and location of the portions to be reversed within the articulations;

wherein the articulations are notes, words, chords, hits or beats, each comprising a waveform with an attack, peak, decay, sustain and release portion;

wherein the centers, or relative centers, are located between the earliest attack portion and the latest release portion.

* * * * *